US007547083B2

(12) United States Patent
Hu et al.

(10) Patent No.: US 7,547,083 B2
(45) Date of Patent: Jun. 16, 2009

(54) INK JET PRINTER WITH A PLURALITY OF PRINTHEAD CONTROL UNITS

(75) Inventors: Hung-Lieh Hu, Hsinchu (TW); Jui-Hua Hu, Taichung County (TW)

(73) Assignee: International United Technology Co., Ltd., Hsin-Chu (TW)

( * ) Notice: Subject to any disclaimer, the term of this patent is extended or adjusted under 35 U.S.C. 154(b) by 27 days.

(21) Appl. No.: 11/832,660

(22) Filed: Aug. 2, 2007

(65) Prior Publication Data

US 2007/0291061 A1 Dec. 20, 2007

Related U.S. Application Data

(62) Division of application No. 10/709,767, filed on May 27, 2004, now Pat. No. 7,284,809.

(30) Foreign Application Priority Data

Apr. 8, 2004 (TW) ..... 93109684 A

(51) Int. Cl.
*B41J 29/38* (2006.01)
*B41J 2/14* (2006.01)

(52) U.S. Cl. ..... 347/9; 347/50

(58) Field of Classification Search ..... 347/9, 347/12, 44, 74, 5, 58, 10, 57, 19, 50, 15
See application file for complete search history.

(56) References Cited

U.S. PATENT DOCUMENTS

| | | | |
|---|---|---|---|
| 4,723,129 | A | 2/1988 | Endo et al. |
| 5,742,305 | A | 4/1998 | Hackleman |
| 5,867,183 | A | 2/1999 | Cornell et al. |
| 6,081,280 | A | 6/2000 | Bolash et al. |
| 6,176,569 | B1 | 1/2001 | Anderson et al. |
| 6,286,924 | B1 | 9/2001 | Ahne et al. |
| 6,299,292 | B1 | 10/2001 | Edwards |
| 6,382,754 | B1 | 5/2002 | Morikoshi et al. |
| 6,437,964 | B1 | 8/2002 | Takamura et al. |
| 6,471,324 | B1 | 10/2002 | Maru |
| 6,481,817 | B1 | 11/2002 | Torgerson et al. |
| 6,698,857 | B2 | 3/2004 | Torgerson et al. |
| 2003/0189608 | A1 | 10/2003 | Hung et al. |
| 2004/0104973 | A1 | 6/2004 | Huang et al. |

FOREIGN PATENT DOCUMENTS

EP 1031421 A1 8/2000

*Primary Examiner*—Stephen D Meier
*Assistant Examiner*—Rene Garcia, Jr.
(74) *Attorney, Agent, or Firm*—Jianq Chyun IP Office

(57) ABSTRACT

An ink jet printer includes a printhead drive unit and a cartridge. The cartridge includes the printhead controller. The printhead controller includes a plurality of inverters connected in series to constitute a operation circuit for receiving one or more control signals to control the enable status of the nozzle in order to determine whether to jet out the ink.

5 Claims, 7 Drawing Sheets

INK JET PRINTER WITH A PLURALITY OF PRINTHEAD CONTROL UNITS

CROSS-REFERENCE TO RELATED APPLICATION

This application is a divisional of an application Ser. No. 10/709,767, filed on May 27, 2004, now allowed as U.S. Pat. No. 7,284,809, which claims the priority benefit of Taiwan application Ser. No. 93109684, filed on Apr. 8, 2004. The full disclosure of each of the above-mentioned patent applications is hereby incorporated herein by reference and made a part of this specification.

BACKGROUND OF THE INVENTION

1. Field of the Invention

This invention generally relates to a printhead controller, and more particularly to a printhead controller of an ink jet printer.

2. Description of Related Art

Computers are widely used in the present era. In addition to displaying the data or images processed by the computer on the display, there are several ways to output the data or images. A printer is one of the most common output devices which can output the text, data, graphics, etc. on the papers.

Currently, the printers can be classified into dot-matrix printers, ink jet printers, and laser printers. Each of these three printers has its own advantages. Hence, users can choose different printers based on their need.

A cartridge installed in a printer can contain ink with one or more different colors. The cartridge jets out the drops of ink, via the nozzles onto the paper to form the text, line, or graphics. Some photo ink jet printers even have the cartridges with pink or pink blue ink for printing images with more colors.

FIG. 1 is an inkjet drive circuit disclosed in the U.S. Pat. No. 6,299,292. As shown in FIG. 1, the drive circuit includes 16 printhead arrays 105. Each printhead array 105 includes 13 heaters H. After the decoder 109 receives the print command, it will send out the address decoding signal of the printhead based on the print command to heat up the heaters H corresponding to the specific addresses so that the ink will be heated and jetted out via the nozzle.

The decoder 109 will send out the printhead array address signals AD1-AD16 and the heater address signals A1-A13. The printhead array address signals AD1-AD16 will determine which printhead array 105 will be driven. The heater address signals A1-A13 will determine which heater H in the specific printhead array 105 will heat the ink. The first terminal of the heater H receives the voltage signal V and the second terminal of the heater H will be controlled by two switches to determine whether current passes through that heater. These two switches comprise MOSFETs 101 and 103. The gate of the MOSFET 103 receives the printhead array address signal; the source (when the MOSFET is a CMOS) receives the heater address signal. When the source and the gate of the MOSFET 103 are enabled at the same time, the drain (when the MOSFET is a CMOS) will generate current signal and send it to the gate of the MOSFET 101. At the time the source-drain of the MOSFET 101 will be turned on when the voltage signal V is supplied, and the heater H will heat the ink and the ink is ready to be jetted out.

FIG. 2 is the inkjet drive circuit disclosed in the U.S. Pat. No. 5,867,183. As shown in FIG. 2, the inkjet drive circuit includes the inkjet printhead drive unit 201 and the printhead ink output units 211 and 213. The inkjet printhead drive unit 201 includes the inkjet printhead drive circuit 203 and the printhead selection circuit 205. The inkjet printhead drive circuit 203 outputs a set of bus control signals 207 and the printhead selection circuit 205 outputs a set of bus selection signal 209 selectively to enable one of the printhead ink output units. The control signals 207 and the corresponding selection signal will determine whether to enable the nozzles of one of the printhead ink output units.

The printhead ink output unit 211 includes the enable circuit 215, the nozzle jetting circuits 225-231 and the nozzle 233. The enable circuit 215 includes a plurality of MOSFETs 217, 219, 221 and 223. The drain (current input) of each MOSFET will receive the corresponding control signal in the bus control signal set 203. The gate (command input) of each MOSFET will receive the corresponding selection signal in the bus selection signal set 209. When the drain and the gate of the same MOSFET are enabled at the same time, the source (output terminal, current output) will generate a current signal to drive the coupled nozzle jetting circuit. For example, the MOSFET 217 is coupled to the nozzle jetting circuit 225 and the MOSFET 219 is coupled to the nozzle jetting circuit 227. Then the nozzle jetting circuit will jet out the ink out of the nozzle 233. The printhead ink output unit 213 works the same as the printhead ink output unit 211.

SUMMARY OF THE INVENTION

The present invention is directed to a printhead control circuit using one or more control signals to control the enable status of the nozzle in order to determine whether or not to jet out the ink.

The present invention is directed to an ink jet printer using the same control signals to drive the printhead control circuits in the cartridges in order to determine whether to jet out the ink.

One or part or all of these and other features and advantages of the present invention will become readily apparent to those skilled in this art from the following description wherein there is shown and described a preferred embodiment of this invention, simply by way of illustration of one of the modes best suited to carry out the invention. As it will be realized, the invention is capable of different embodiments, and its several details are capable of modifications in various, obvious aspects all without departing from the invention. Accordingly, the drawings and descriptions will be regarded as illustrative in nature and not as restrictive.

According to an embodiment of the present invention, the printhead controller comprises a buffer circuit for receiving an address signal and a selection signal and an ink jetting circuit for receiving the buffer signal and determining whether to jet out ink based on the buffer signal. The buffer circuit is adapted for outputting a buffer signal corresponding to the selection signal.

In an embodiment of the present invention, the address signal is a working driving voltage of the buffer circuit. The buffer circuit includes a plurality of inverters connected in series. The inverters comprise, for example, FETs.

In an embodiment of the present invention, the buffer circuit includes a first resistor having a first terminal for receiving the address signal; a first FET having a first terminal being coupled to a second terminal of the first resistor for outputting an inverted signal, a third terminal being coupled to a ground, and a second terminal of the first FET for receiving the selection signal; a second resistor having a first terminal for receiving the address signal; and a second FET having a first terminal being coupled to a second terminal of the second resistor for outputting the buffer signal, a second terminal of the second FET for receiving the inverted signal and a third terminal of the second FET being coupled to the ground.

The present invention provides an ink jet printer comprising a printhead drive unit including a printhead drive circuit and a printhead selection circuit. The printhead drive circuit is adapted for outputting a plurality of address signals, and the printhead selection circuit is adapted for outputting a plurality of selection signals. The printhead module deposed within the printer comprises a plurality of printhead control units. Each printhead control unit is adapted for receiving the plurality of address signals and the selection signal corresponding to the printhead control unit for controlling the enable status of the heaters or transducers corresponding to the nozzles in the printhead control unit to determine whether or not to jet out the ink.

In an embodiment of the present invention, each of the printhead control units includes a plurality of buffer circuits, a plurality of ink jetting circuits and a plurality of nozzles. Each of the plurality of buffer circuits is adapted for receiving an address signal and a selection signal. Each of the plurality of buffer circuits is adapted for outputting a buffer signal corresponding to the selection signal. Each of the plurality of ink jetting circuits is adapted for receiving the buffer signal and determining whether or not to jet out ink based on the buffer signal. Each of the plurality of nozzles corresponds to one of the plurality of ink jetting circuits for jetting out the ink. The heater or transducer corresponding to each nozzle is coupled to the corresponding ink jetting circuit for adding pressure or vaporize the ink for jetting out ink.

In light of the above, the printhead controller of the present invention can use a plurality of serial-connected inverters to constitute a buffer circuit for receiving one or more control signals to control the enable status of the nozzle in order to determine whether or not to jet out the ink.

DESCRIPTION OF THE EMBODIMENTS

Figure 1:
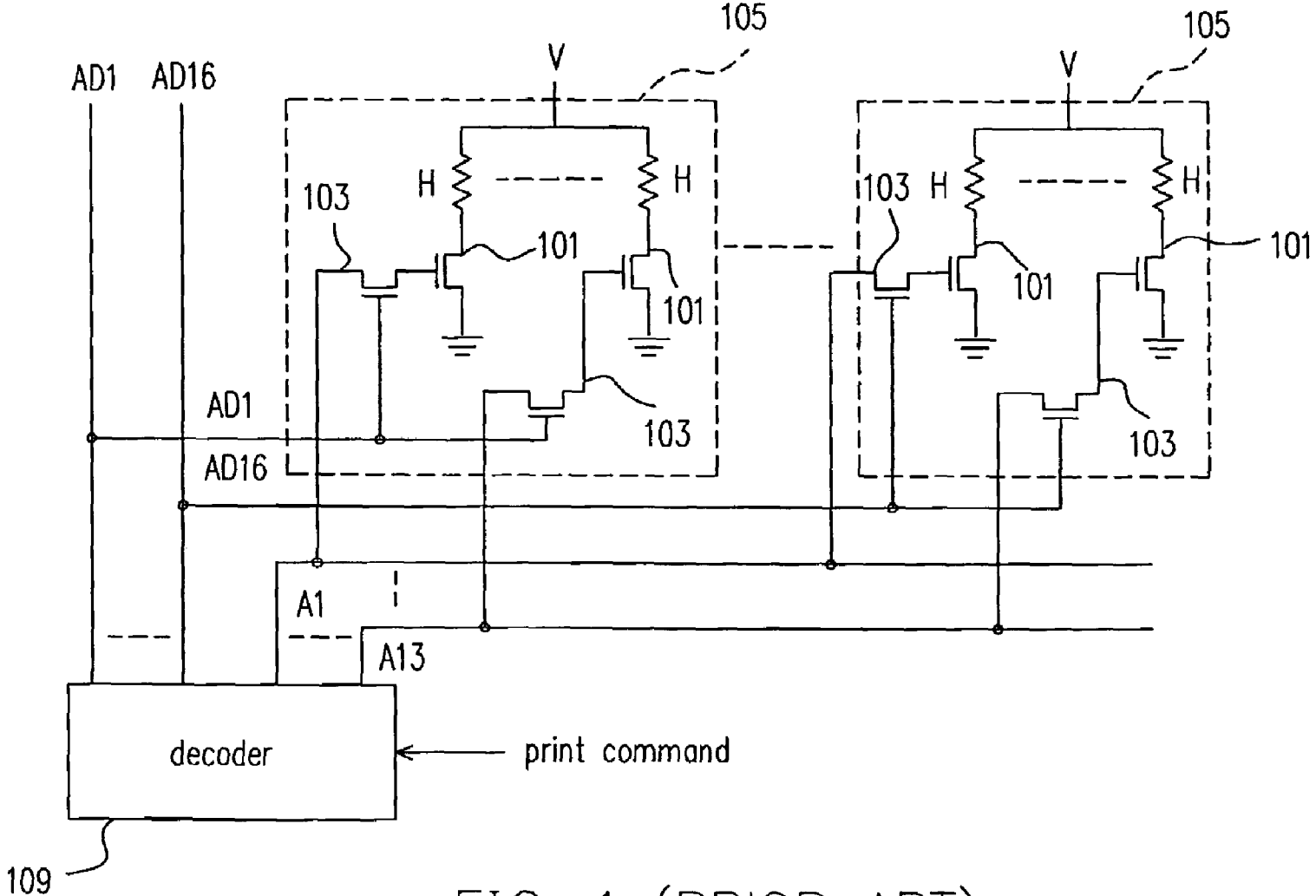
FIG. 1 (PRIOR ART)
FIG. 1 is a circuit diagram of a traditional inkjet drive circuit.
Figure 2:
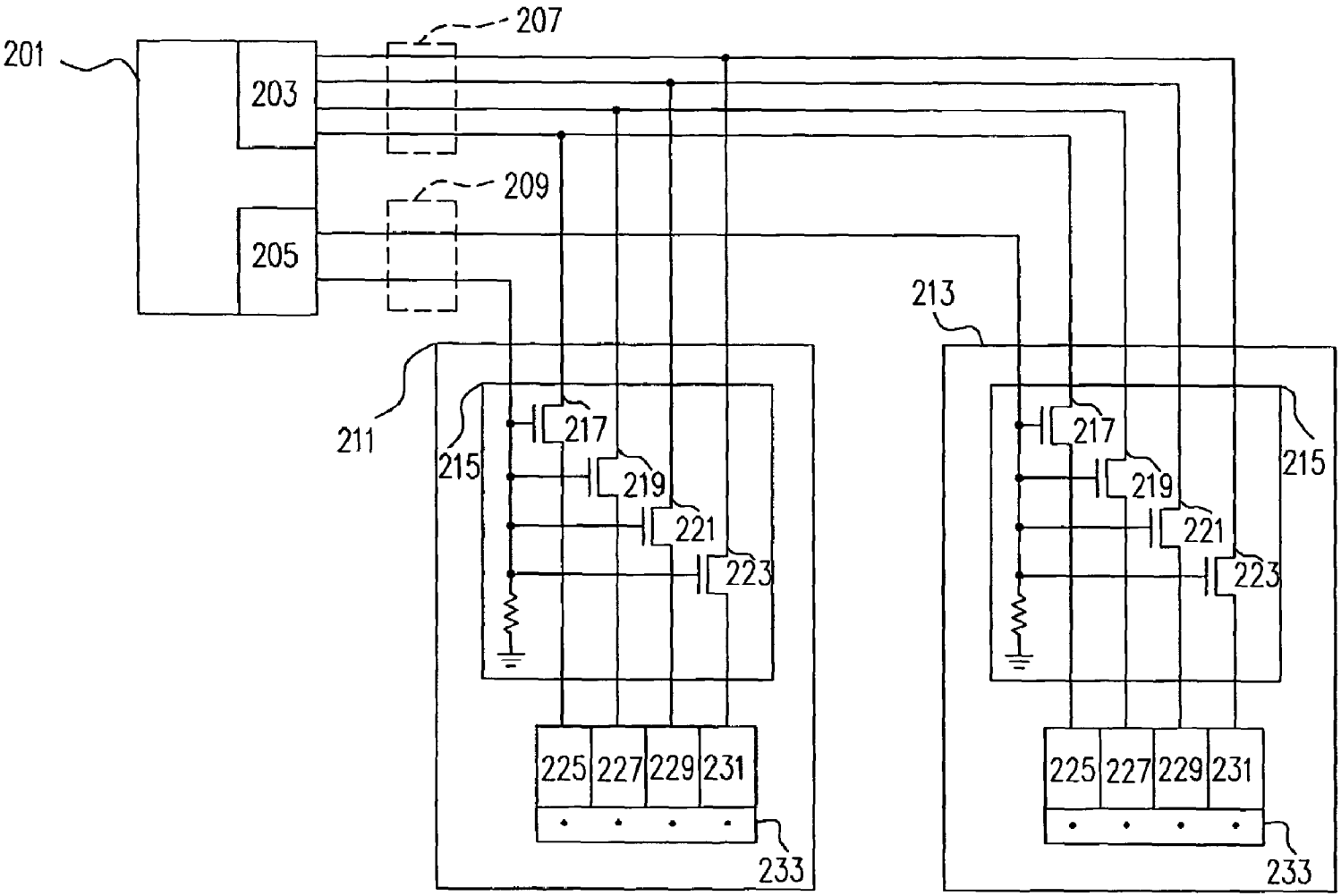
FIG. 2 (PRIOR ART)
FIG. 2 is another circuit diagram of a traditional inkjet drive circuit.
Figure 3:
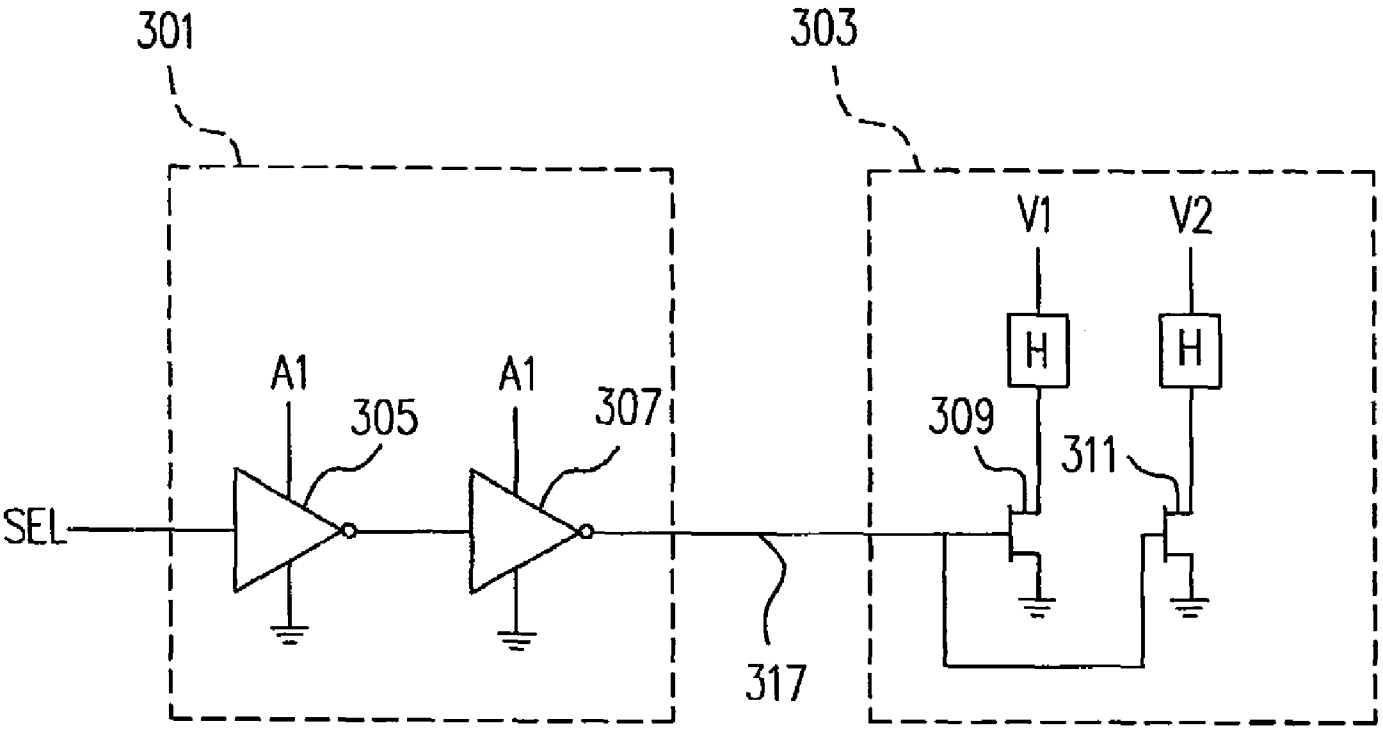
FIG. 3 is a circuit diagram of a printhead controller in accordance with an embodiment of the present invention.

FIG. 3 is a circuit diagram of a printhead controller in accordance with an embodiment of the present invention. As shown in FIG 3, the printhead controller includes the buffer circuit 301 and the ink jetting circuit 303. The buffer circuit 301, also termed as the operation circuit, includes the inverters 305 and 307 connected in series. The working driving voltages of these two inverters are controlled by the same address signal A1. The input terminal of the inverter 305 receives and inverts the selection signal SEL. Then the inverter 305 outputs the inverted signal via the output terminal of the inverter 305 to the inverter 307. After the inverse operation by the inverter 307, the buffer signal is outputted from the output terminal of the inverter 307 to the ink jetting circuit 303 via the transmission line 317. Here, as can been understood, the buffer signal output from the buffer circuit 301 is also serving as a switching signal to switch ON/OFF the MOSFETs 309 and 311.

The ink jetting circuit 303 includes, for example, but is not limited to, two MOSFETs 309 and 311. The gates of the MOSFETs 309 and 311 receive the buffer signal form the inverter 307. When the buffer signal received by the ink jetting circuit 303 is at the high voltage level, the MOSFETs 309 and 311 are turned on and the heaters H will heat the ink up depending on the status of voltage V1 and V2 for jetting ink out via the nozzle of the cartridge. In this embodiment, the buffer signal received by the ink jetting circuit 303 is the voltage signal. In other words, the on/off of MOSFETs in the ink jetting circuit 303 depends on the voltage level. The MOSFETs can also be driven by current by adding a resistor on the transmission line 317 and coupling it to the ground.

Figure 4:
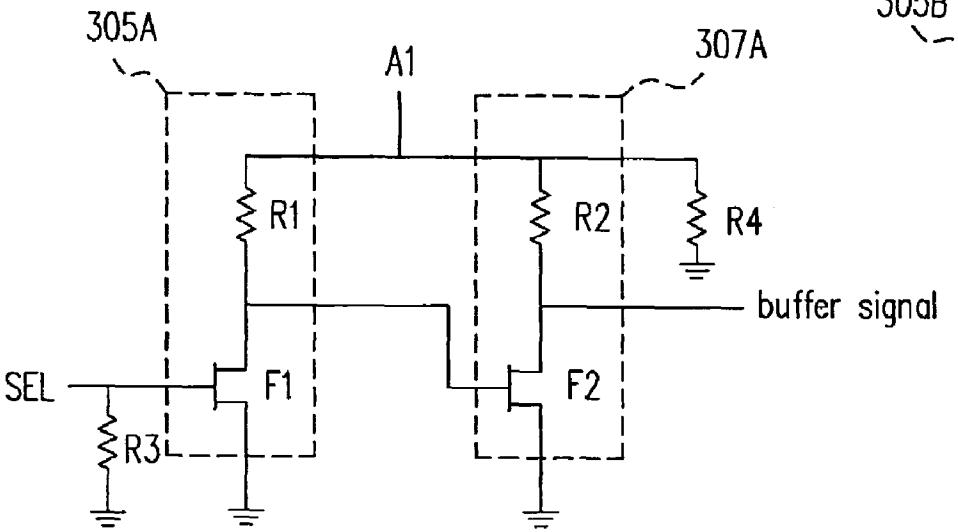
FIG. 4 is a circuit diagram of a buffer circuit in accordance with an embodiment of the present invention.

FIG. 4 is a circuit diagram of a buffer circuit in accordance with an embodiment of the present invention. As shown in FIG. 4, the buffer circuit includes two inverters 305A and 307A. The inverter 305A includes the MOSFET F1 and the resistor R1, and the inverter 307A includes the MOSFET F2 and the resistor R2. The driving voltage of these two inverters is controlled by the address signal A1. The gate of the MOSFET F1 of the inverter 305A is coupled in series with the resistor R3 and then coupled to the ground. The gate of the MOSFET F1 receives the selection signal SEL to determine whether or not to turn on MOSFET F1 in order to output the corresponding inverted signal. The gate of the MOSFET F2 of the inverter 307 receives the inverted signal and then outputs the corresponding buffer signal in order to determine the subsequent operation of the circuit. In this embodiment, as shown in FIG. 4, the resistors R1 and R2 range from 0.5 kΩ to 500 kΩ. The preferred resistance of the resistors R1 and R2 range from 20 kΩ to 80 kΩ. The resistors R3 and R4 range from 1 kΩ to 500 kΩ. The preferred resistance of the resistors R1 and R2 ranges from 20 kΩ to 80 kΩ.

Figure 5:
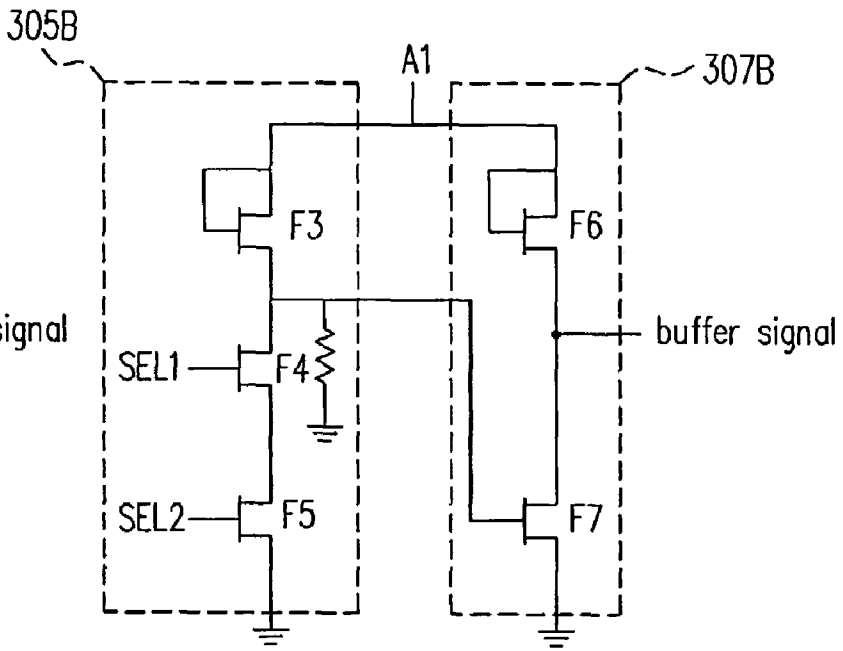
FIG. 5 is a circuit diagram of a buffer circuit in accordance with another embodiment of the present invention.

FIG. 5 is a circuit diagram of a buffer circuit in accordance with another embodiment of the present invention. As shown in FIG. 5, the buffer circuit includes two inverters 305B and 307B, each of which consists of MOSFETs. The inverter 305B includes the MOSFETs F3, F4 and F5 connected in series; the inverter 307B includes the MOSFETs F6 and F7. The difference between this embodiment and the embodiment in FIG. 4 is that buffer circuit in this embodiment can receive two selection signals SEL1 and SEL2. The inverter 307B then outputs the corresponding buffer signal based on the statuses of these two selection signals SEL1 and SEL2.

In the inverter 305B, the drain and the gate of MOSFET F3 are coupled to each other to form the drain feedback. The drain receives the address signal A1; the source is coupled to the drain of MOSFET F4 and outputs the inverted signal. The gate of MOSFET F4 receives the selection signal SEL1; the source of MOSFET F4 is coupled to the drain of MOSFET F5. The gate of MOSFET F5 receives the selection signal SEL2; the source of MOSFET F5 is grounded. When one of the selection signals SEL1 and SEL2 is at the low voltage level, one of the MOSFETs cannot be turned on. Hence, the inverted signal is at the high voltage level. On the other hand, when both of the selection signals SEL1 and SEL2 are at the high voltage level, the inverted signal is at the low voltage level. The MOSFET F3 in the inverter 305B can be replaced by the resistor R1 in FIG. 4. Further, in this embodiment, the selection signal SEL2 received by the MOSFET F5 can be replaced by the address signal A1 and the same result can be achieved (i.e., when MOSFET F4 and MOSFET F5 receive the high voltage signals, the inverted signal is at the low voltage level).

In the inverter 307B, like the MOSFET F3, the drain and the gate of MOSFET F6 are coupled to each other to form the drain feedback. The source of MOSFET F6 is coupled to MOSFET F7 and outputs the buffer signal according to the inverted signal. The gate of MOSFET F7 receives the inverted signal and the source of MOSFET F7 is grounded.

When the buffer circuit is required to receive more selection signal for determination, one skilled in the art can connect the other MOSFETs to MOSFET F5 in the inverter 305B in series and input the new added selection signals (or address signals) to the gates of the new added MOSFETs to satisfy the requirement of inputting more selection signals in an specific embodiment.

Figure 6:
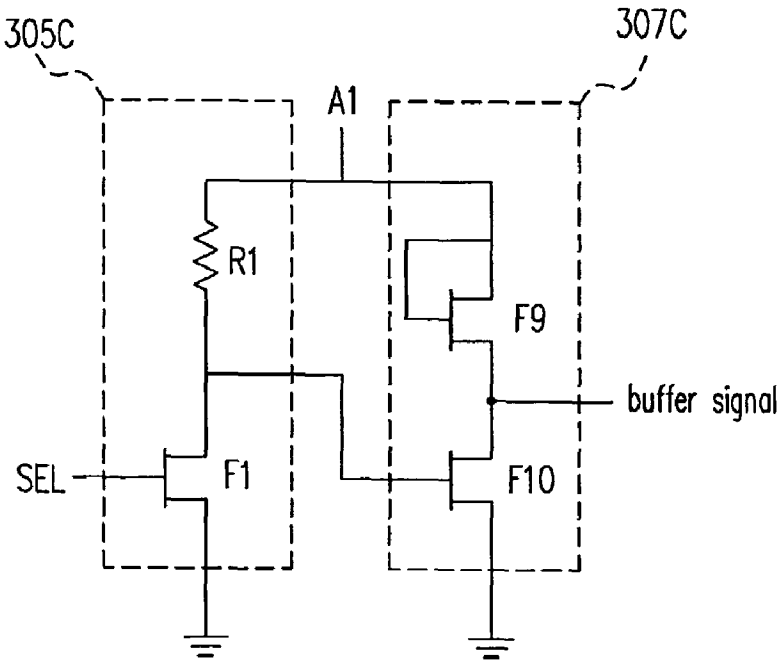
FIG. 6 is a circuit diagram of a buffer circuit in accordance with still another embodiment of the present invention.

FIG. 6 is a circuit diagram of a buffer circuit in accordance with still another embodiment of the present invention. As shown in FIG. 6, the buffer circuit includes two inverters 305C and 307C, wherein the inverter 305C is same as the inverter 305A. In the inverter 307C, the gate and the drain of MOSFET F9 are coupled to each other to form the drain feedback. The drain of MOSFET F9 receives the address signal; the source of MOSFET F9 is coupled to the drain of MOSFET F10 and outputs the buffer signal. The gate of MOSFET F10 receives the inverted signal from the inverter 305C and determines whether or not to turn on/off MOSFET F10 based on the voltage level of the inverted signal. The source of MOSFET F10 is grounded.

Figure 7:
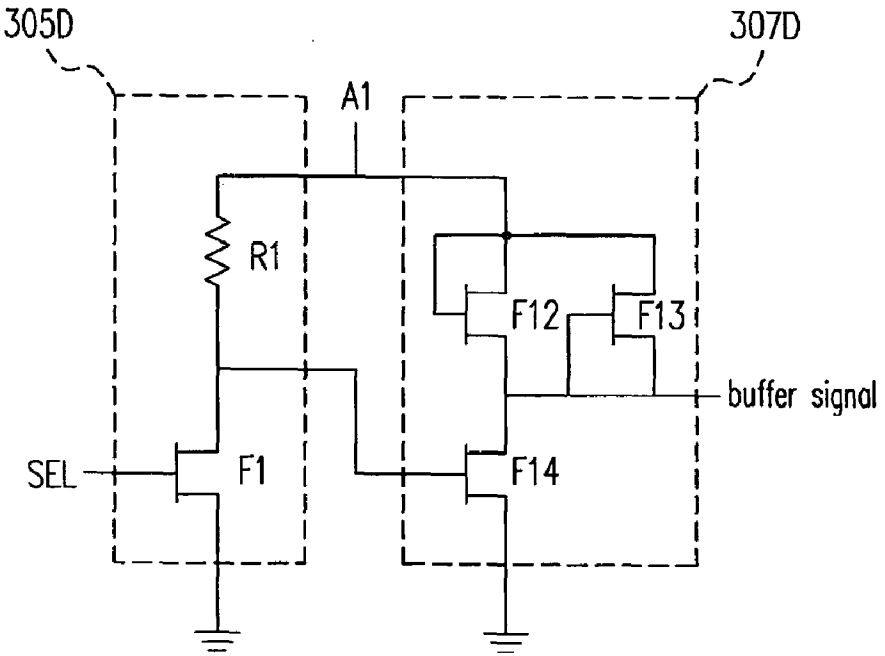
FIG. 7 is a circuit diagram of a buffer circuit in accordance with further still another embodiment of the present invention.

FIG. 7 is a circuit diagram of a buffer circuit in accordance with still another embodiment of the present invention. As shown in FIG. 7, the buffer circuit includes two inverters 305D and 307D, wherein the inverter 305D is the same as the inverter 305A. In the inverter 307D, the drain of MOSFET F12 receives the address signal; and the gate and the drain of MOSFET F13 are coupled to each other. The source of MOSFET F13 outputs the buffer signal. The gate and the source of MOSFET F13, the source of MOSFET F12, and the drain of MOSFET F14 are coupled together. The gate of MOSFET F14 receives the inverted signal from the inverter 305D to determine whether or not to turn on/off MOSFET F14. The source of MOSFET F14 is grounded.

Figure 8:
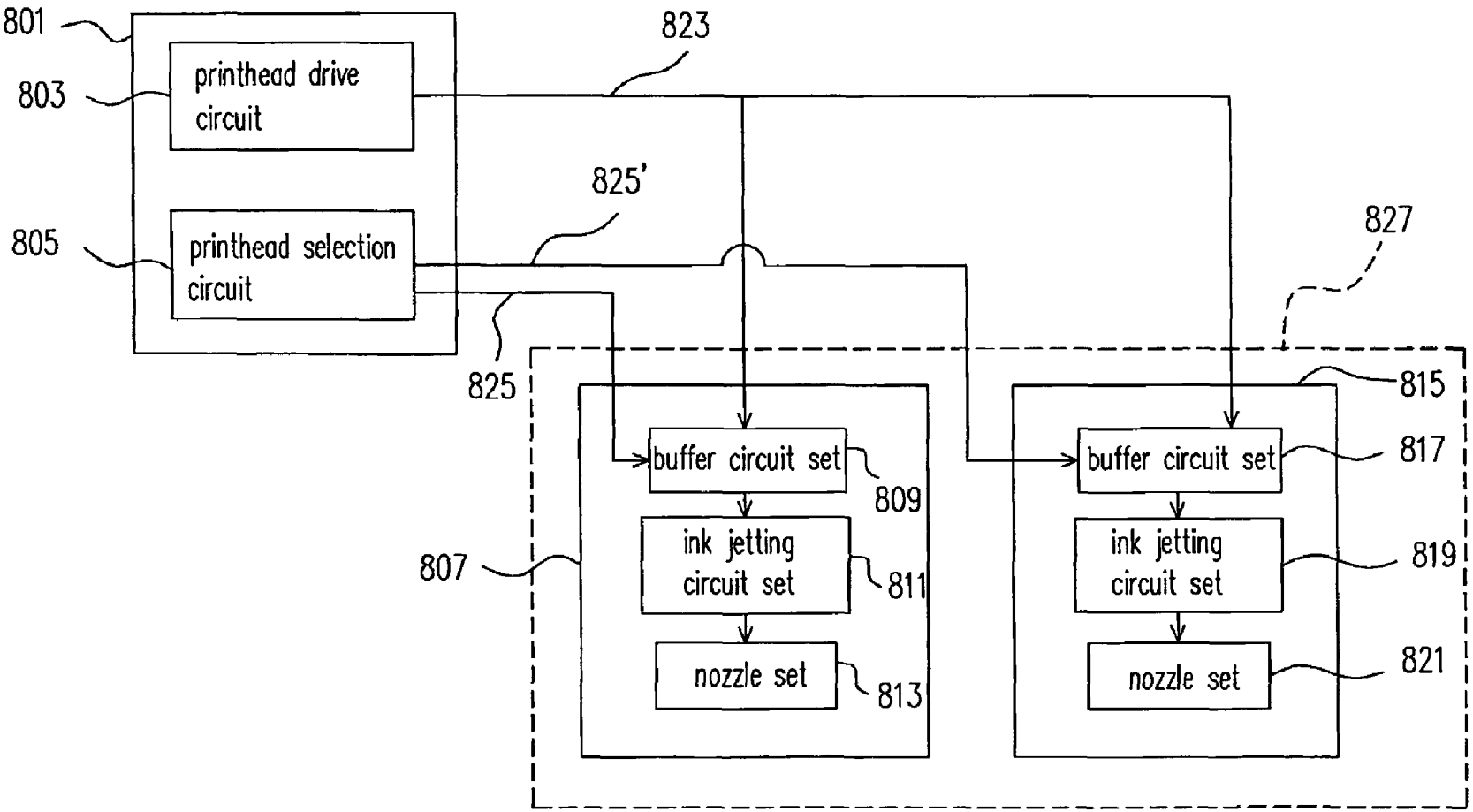
FIG. 8 is a block diagram of an ink jet printer in accordance with an embodiment of the present invention.

FIG. 8 is a block diagram of an ink jet printer in accordance with an embodiment of the present invention. As shown in FIG. 8, the ink jet printer includes the printhead drive unit 801. The printhead drive unit 801 includes the printhead drive circuit 803 and the printhead selection circuit 805. The printhead module 827 installed in the ink jet printer includes two cartridges and the corresponding printhead control circuits which are the black printhead control circuit 807 and the color printhead control circuit 815. The printhead drive circuit 803 of the printhead drive unit 801 outputs address signals; the printhead selection circuit 805 outputs a set of selection signals (wherein one of the set of selection signals is high while the other are low to selectively enable one printhead control circuit). The address signals and the selection signal corresponding to one printhead control circuit are used to control whether to enable the nozzles of one printhead control circuit in the ink jet printer. In other embodiments, there can be more than two cartridges installed in the printer.

The buffer circuit set 809 of the black printhead control circuit 807 of the printhead module 827 receives the address signal and the selection signal via the transmission lines 823 and 825. After receiving the buffer signal, the ink jetting circuit 811 will determine whether or not to jet out the ink based on the buffer signal. If it is determined to jet out the ink, the ink will be jetted out via the nozzle set 813.

The operation of the color printhead control circuit 815 is same as the black printhead control circuit 807. The buffer circuit set 817 of the color printhead control circuit 815 of the printhead module 827 receives the address signal and the selection signal via the transmission lines 823 and 825'. After receiving the buffer signal, the ink jetting circuit 819 will determine whether or not to jet out the ink based on the buffer signal. If it is determined to jet out the ink, the ink will be jetted out via the nozzle set 821.

In the embodiment mentioned above, the address signals and the selection signals of the black printhead control circuit 807 and the color printhead control circuit 815 are sent by the transmission lines 823, 825, and 825'. That is, the ink jet printer can control the operation of the two printheads in the printhead set 827 by using three signals transmitted by the printhead drive unit 801. It is noted that when one of the two printhead is driven, the voltage level of the selection signal of the other one printhead is low. If more cartridges are required, only addition of new corresponding selection signals is required. The new added printhead control circuits are only required to receive the same address signals.

In addition, the buffer circuit sets 809 and 817 have a plurality of buffer circuits. Each buffer circuit directly receives the address signal and the selection signal and outputs the corresponding buffer signal. Likewise, the ink jetting circuit set 811 and 819 have a plurality of ink jetting circuits. Each ink jetting circuit is coupled to a specific buffer circuit and receives the buffer signal from the buffer circuit. The nozzle sets 813 and 821 have a plurality of nozzles. When the ink jetting circuit determines to jet out the ink, the corresponding nozzles will jet out the ink.

Figure 9:
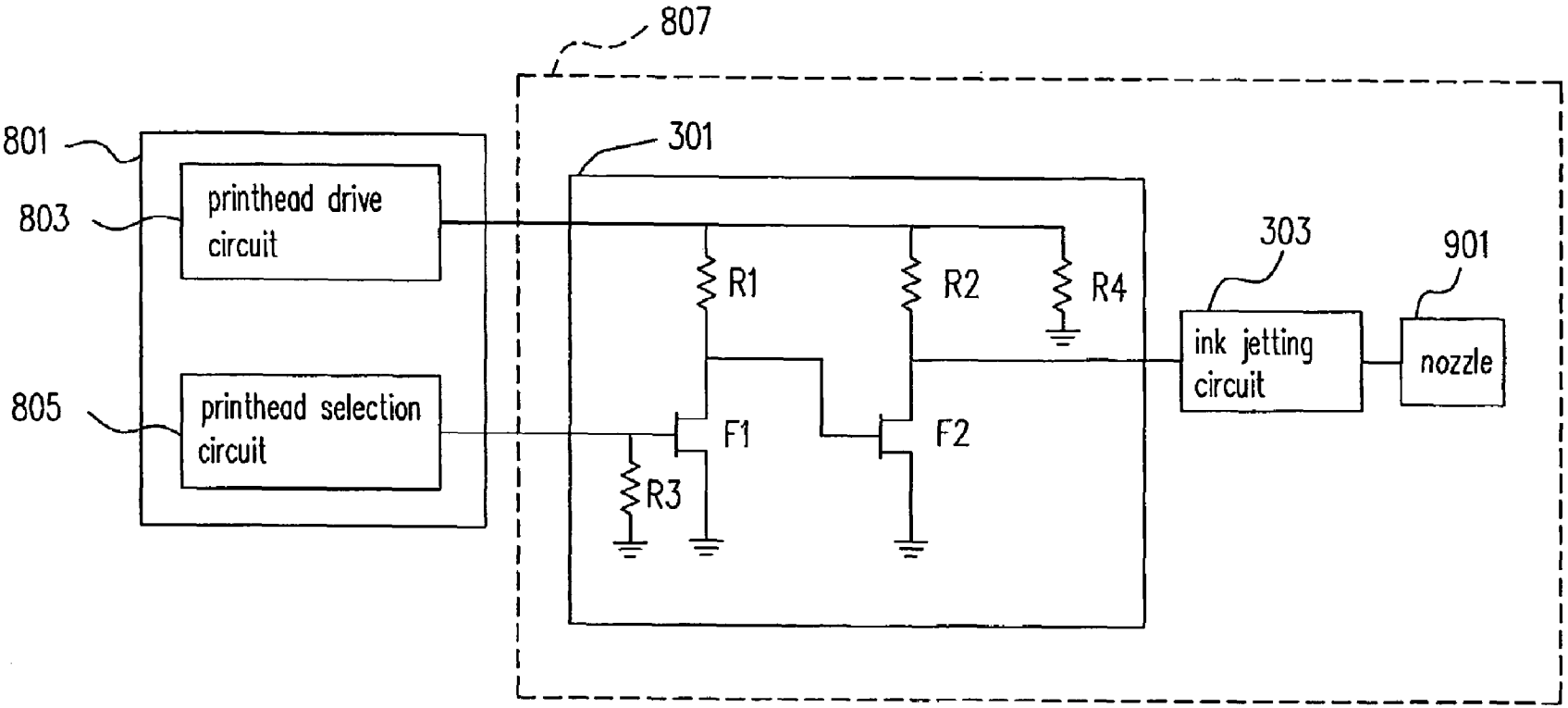
FIG. 9 is a block diagram of an ink jet printer in accordance with another embodiment of the present invention.

FIG. 9 is a block diagram of an ink jet printer in accordance with another embodiment of the present invention. The ink jet printer includes the printhead drive circuit 801 and the black printhead control circuit 807. Like the embodiment of FIG. 8, the printhead drive circuit 801 includes the printhead drive circuit 803 and the printhead selection circuit 805 for sending the address signal and the selection signal.

The black printhead control circuit 807 includes the buffer circuit 301, the ink jetting circuit 303 and the nozzle 901. The working driving voltages of the MOSFETs F1 and F2 of the buffer circuit 301 are controlled by the address signal from the printhead drive circuit 803. The gate of MOSFET F1 receives the selection signal from the printhead selection circuit 805 and outputs the inverted signal to MOSFET F2 based on the selection signal. Then MOSFET F2 outputs the buffer signal to the ink jetting circuit 303 based on the inverted signal. If it is determined to jet out the ink, the ink jetting circuit will heat up the ink and the nozzle 901 then jets out the ink.

Although in this embodiment the black printhead control circuit 807 only includes one buffer circuit set, one skilled in the art can expand one buffer circuit set to several buffer circuit sets. In addition, this embodiment is also applied to the other color cartridges.

In light of the above, the printhead controller of the present invention can use a plurality of serial-connected inverters to constitute a buffer circuit for receiving one or more control signals to control the enable status of the nozzle in order to determine whether or not to jet out the ink. In addition, the ink jet printer of the present invention can use the same signals to control several printheads in order to reduce the circuit complexity.

The foregoing description of the preferred embodiment of the present invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An ink jet printer, comprising:

a printhead drive unit, including a printhead drive circuit and a printhead selection circuit, said printhead drive circuit outputting a plurality of address signals, said printhead selection circuit outputting a plurality of selection signals; and a plurality of printhead control units, each of said printhead control units receiving said address signals and corresponding one of said plurality of selection signals, each said printhead control unit including:

a plurality of operation circuits, each of said plurality of operation circuits for receiving one of said address signals and one of said selection signals, each of said plurality of operation circuits including a plurality of inverters connected in series and outputting a switching signal corresponding to said received selection signal and said received address signal, said plurality of inverters including at least a first inverter and a second inverter, said first inverter being adapted for receiving said received selection signal, each of said plurality of inverters of each of said operation circuits being adapted for receiving the same said received address signal;

a plurality of ink jetting circuits, each of said plurality of ink jetting circuits for receiving said switching signal outputting from corresponding said operation circuit and determining whether or not to jet out ink based on said received switching signal, wherein said received address signal and said received selection signal have a voltage level of a logic high voltage level and a logic low voltage level, said received switching signal is a logic high voltage level and selectively enables said ink jetting circuit when said received address signal and said received selection signal are at the logic high voltage level; and a plurality of nozzles, each of said plurality of nozzles corresponding to one of said plurality of ink jetting circuits for jetting out said ink.

2. The ink jet printer of claim 1, wherein said received address signal is a working driving voltage of the corresponding said operation circuit.

3. The ink jet printer of claim 1, wherein each of said inverters includes a FET.

4. The ink jet printer of claim 3, wherein said inverters of each of said operation circuits includes:

a first resistor, having a first terminal for receiving said received address signal;

a first FET, having a first terminal being coupled to a second terminal of said first resistor and outputting an inverted signal, a second terminal for receiving said received selection signal, and a third terminal being coupled to a ground;

a second resistor, having a first terminal for receiving said received address signal; and a second FET, having a first terminal being coupled to a second terminal of said second resistor and outputting said received switching signal, a second terminal for receiving said inverted signal, and a third terminal being coupled to said ground.

5. The ink jet printer of claim 1, wherein said second inverter of each of said operation circuits is adapted for outputting said switching signal.

* * * * *